US009873930B2

(12) United States Patent
Oikawa et al.

(10) Patent No.: US 9,873,930 B2
(45) **Date of Patent: *Jan. 23, 2018**

(54) PRECIPITATION HARDENING MARTENSITIC STAINLESS STEEL AND STEAM TURBINE COMPONENT MADE THEREOF

(75) Inventors: Shinji Oikawa, Hitachi (JP); Hideo Yoda, Hitachi (JP); Masahiko Arai, Hitachinaka (JP); Hiroyuki Doi, Tokai (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 1005 days.

This patent is subject to a terminal disclaimer.

(21) Appl. No.: 13/292,126

(22) Filed: Nov. 9, 2011

(65) Prior Publication Data

US 2012/0114496 A1 May 10, 2012

(30) Foreign Application Priority Data

Nov. 9, 2010 (JP) ..... 2010-250363

(51) Int. Cl.

| | |
|---|---|
| ***C22C 38/44*** | (2006.01) |
| ***C22C 38/18*** | (2006.01) |
| ***C21D 6/00*** | (2006.01) |
| ***C21D 6/02*** | (2006.01) |
| ***C21D 9/00*** | (2006.01) |
| ***C22C 38/40*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/60*** | (2006.01) |

(52) U.S. Cl.

CPC ..... *C22C 38/18* (2013.01); *C21D 6/00* (2013.01); *C21D 6/004* (2013.01); *C21D 6/02* (2013.01); *C21D 9/0068* (2013.01); *C22C 38/40* (2013.01); *C22C 38/44* (2013.01); *C22C 38/46* (2013.01); *C22C 38/48* (2013.01); *C22C 38/50* (2013.01); *C22C 38/52* (2013.01); *C22C 38/60* (2013.01); *C21D 2211/008* (2013.01)

(58) Field of Classification Search

CPC ..... C22C 38/02; C22C 38/04; C22C 38/40
See application file for complete search history.

(56) References Cited

U.S. PATENT DOCUMENTS

| | | | | |
|---|---|---|---|---|
| 3,556,776 | A * | 1/1971 | Clarke et al. | C22C 38/44 420/52 |
| 8,747,733 | B2 * | 6/2014 | Oikawa et al. | 420/63 |
| 2006/0118215 | A1 * | 6/2006 | Hirakawa et al. | 148/607 |
| 2007/0023108 | A1 | 2/2007 | Blanke | |
| 2010/0139817 | A1 | 6/2010 | Montagnon | |
| 2011/0014083 | A1 * | 1/2011 | Amaya | C22C 38/001 420/40 |
| 2011/0255988 | A1 * | 10/2011 | Oikawa et al. | 416/241 R |

FOREIGN PATENT DOCUMENTS

| | | | |
|---|---|---|---|
| EP | 1 669 473 | A1 | 6/2006 |
| EP | 2377962 | | 10/2011 |
| JP | 63-210234 | | 8/1988 |
| JP | 63210234 | A * | 8/1988 |
| JP | 02-310339 | | 12/1990 |
| JP | 02310339 | A * | 12/1990 |
| JP | 2001-98349 | | 4/2001 |
| JP | 2005171339 | A * | 6/2005 |
| JP | 2005-194626 | | 7/2005 |
| JP | 2008-88550 | | 4/2008 |
| JP | 2008-546912 | | 12/2008 |
| WO | WO 01/14601 | | 3/2001 |
| WO | WO 2004/078224 | A1 | 9/2004 |
| WO | WO 2007/003748 | A1 | 1/2007 |

OTHER PUBLICATIONS

JP 02310339 A of Imazu et al.—JP 63210234 A of Tanaka et al.*
Kumar, A., et al. "Influence of Bainite/Martensite-Content on the Tensile Properties of Low Carbon Dual-Phase Steels." Materials Science & Engineering a, vol. 474, Jan. 1, 2008, pp. 270-282.*
English Machine Translation of JP 2005171339 A.*
JP Office Action of Appln. No. 2010-250363 dated Jan. 21, 2014 with partial English translation.
Chinese Office Action of Appln. No. 201110349149.7 dated Jun. 6, 2013 with English translation.
EP Search Report of Appln. No. 11188417.7 dated Apr. 24, 2012 in English.

* cited by examiner

*Primary Examiner* — Jessee Roe
*Assistant Examiner* — Jophy S Koshy
(74) *Attorney, Agent, or Firm* — Crowell & Moring LLP

(57) ABSTRACT

It is an objective of the present invention to provide a precipitation-hardening martensitic stainless steel having well-balanced properties of high mechanical strength, high toughness and good corrosion resistance properties. There is provided a precipitation-hardening martensitic stainless steel comprising: 0.10 mass % or less of C; 13.0 to 15.0 mass % of Cr; 7.0 to 10.0 mass % of Ni; 2.0 to 3.0 mass % of Mo; 0.5 to 2.5 mass % of Ti; 0.5 to 2.5 mass % of Al; 0.5 mass % or less of Si; 0.1 to 1.0 mass % of Mn; and the balance including Fe and incidental impurities, in which the mass % content of the Ti (represented by [Ti content]), the mass % content of the Al (represented by [Al content]) and the mass % content of the C (represented by [C content]) satisfy relationships of "0.5≤[Ti content]≤2.5" and "0.5≤[Al content]+2[C content]≤2.7".

7 Claims, 3 Drawing Sheets

PRECIPITATION HARDENING MARTENSITIC STAINLESS STEEL AND STEAM TURBINE COMPONENT MADE THEREOF

CLAIM OF PRIORITY

The present application claims priority from Japanese patent application serial no. 2010-250363 filed on Nov. 9, 2010, the content of which is hereby incorporated by reference into this application.

BACKGROUND OF THE INVENTION

1. Field of the Invention

The present invention relates to steels having high mechanical properties, and particularly to precipitation hardening martensitic stainless steels and steam turbine components made thereof.

2. Description of Related Art

Because of the recent trend toward the conservation of energies (such as fossil fuel energy) and the global warming prevention (such as suppression of $CO_2$ gas emission), a strong demand exists to increase the efficiencies of apparatuses (such as steam turbines) used in thermal power plants. An effective measure to improve the efficiency of steam turbines is to increase the radial length of the long blades of the turbine. This has an additional effect of reducing the number of turbine casings, thereby leading to a reduction in construction time and cost.

Currently, martensitic stainless steels are used for the long blades of steam turbines in ultra super critical (USC) power plants. A problem here is that the longer radial length a turbine blade has, the much stronger centrifugal force the blade receives. However, conventional martensitic stainless steels may not have sufficient mechanical strength to withstand such stronger centrifugal force. Thus, there is need for steam turbine long blade materials having higher mechanical strength. Such blade materials also require high toughness in order to prevent sudden rupture.

For example, JP-A 2001-098349 discloses a martensitic stainless steel that has high mechanical strength and high toughness and is advantageously used for steam turbine blades.

As already described, materials having both high mechanical strength and high toughness are needed to increase the radial length of steam turbine long blades. Steam turbine long blades are used in a harsh corrosive environment because they are exposed to a severe dry and wet cycle. Therefore, steels used for steam turbine long blades also require high corrosion resistance (such as high stress corrosion cracking (SCC) resistance).

Generally, steels have a trade-off between mechanical strength and corrosion resistance. Martensitic stainless steels have high mechanical strength, but have relatively poor corrosion resistance. Therefore, there is need for martensitic stainless steels having higher corrosion resistance. Of the martensitic stainless steels, precipitation-hardening martensitic stainless steels have high corrosion resistance properties (such as high SCC resistance) since they have a relatively high Cr (chromium) content and a relatively low C (carbon) content. Unfortunately, they have a disadvantage of relatively low mechanical strength. JP-A 2005-194626 discloses a precipitation-hardening martensitic stainless steel having high mechanical strength. However, the corrosion resistance may possibly be sacrificed for the increased mechanical strength.

SUMMARY OF THE INVENTION

In view of the foregoing, it is an objective of the present invention to provide a precipitation-hardening martensitic stainless steel having well-balanced properties of high mechanical strength, high toughness and good corrosion resistance properties (such as high SCC resistance). Furthermore, it is another objective of the invention is to provide a steam turbine component made of the invented precipitation-hardening martensitic stainless steel.

According to one aspect of the present invention, there is provided a precipitation-hardening martensitic stainless steel including: 0.10 mass % or less of C, 13.0 to 15.0 mass % of Cr; 7.0 to 10.0 mass % of Ni; 2.0 to 3.0 mass % of Mo; 0.5 to 2.5 mass % of Ti; 0.5 to 2.5 mass % of Al; 0.5 mass % or less of Si; 0.1 to 1.0 mass % of Mn; and the balance including Fe and incidental impurities, in which the mass % content of the Ti (represented by [Ti content]), the mass % content of the Al (represented by [Al content]) and the mass % content of the C (represented by [C content]) satisfy relationships of "0.5≤[Ti content]≤2.5" and "0.5≤[Al content]+2[C content]≤2.7".

In the above aspect of the present invention, the following modifications and changes can be made.

i) The precipitation-hardening martensitic stainless steel further includes at least one of Nb, V and Ta in a total content of 0.05 to 0.5 mass %.

ii) Part or all of the Mo is replaced by W.

iii) The precipitation-hardening martensitic stainless steel further includes 0.5 to 1.0 mass % of Co and 0.5 to 1.0 mass % of Re.

iv) The incidental impurities include at least one of: 0.1 mass % or less of P; 0.1 mass % or less of S; 0.1 mass % or less of Sb; 0.1 mass % or less of Sn; and 0.1 mass % or less of As.

v) The stainless steel is subjected to a solution heat treatment at 900 to 950° C. followed by an aging heat treatment at 530 to 580° C.

vi) There is provided a long blade with a length of 48 to 60 inches made of the precipitation-hardening martensitic stainless steel for a 3600 rpm steam turbine.

vii) There is provided a rotor including the long blade above.

viii) There is provided a steam turbine including the rotor above.

ix) There is provided a thermal power plant using the steam turbine above.

(Advantages of the Invention)

According to the present invention, it is possible to provide a precipitation-hardening martensitic stainless steel having well-balanced properties of high mechanical strength, high toughness and good corrosion resistance properties (such as high SCC resistance). Also, it is possible to provide a steam turbine component made of the invented precipitation-hardening martensitic stainless steel.

DETAILED DESCRIPTION OF THE PREFERRED EMBODIMENTS

Figure 1:
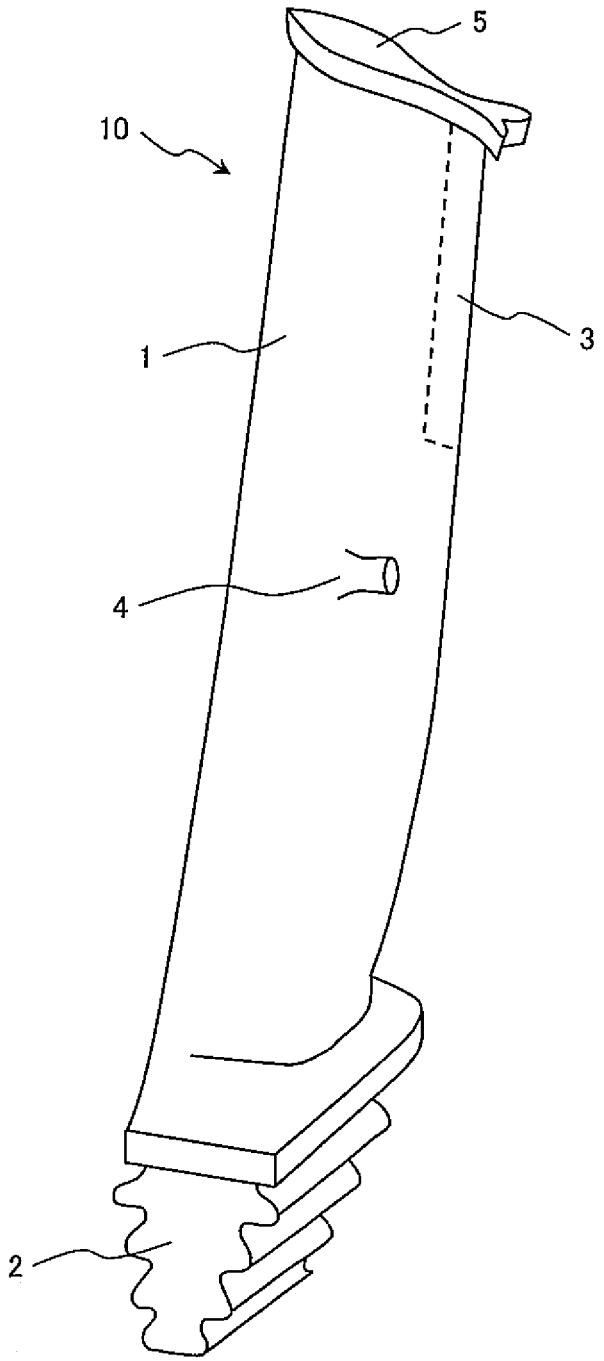
FIG. 1 is a schematic illustration showing a perspective view of an exemplary steam turbine long blade made of an invented stainless steel.

Preferred embodiments of the invention will be described below with reference to the accompanying drawings. The invention is not limited to the specific embodiments described below, but various combinations and modifications are possible without departing from the spirit and scope of the invention.

(Composition of Precipitation-Hardening Martensitic Stainless Steel)

The composition of the precipitation-hardening martensitic stainless steel according to the present invention will be described below.

Addition of C (carbon) suppresses formation of a δ-ferrite phase which has an adverse effect on the mechanical properties and SCC resistance of the resulting stainless steel. Also, C forms a compound with Cr (chromium), Ti (titanium), Mo (molybdenum) or other elements, thus having a precipitation-hardening effect. However, the addition of more than 0.10 mass % of C decreases the toughness of the resulting stainless steel due to excessive precipitation of carbon compounds and also degrades the corrosion resistance due to decreased Cr concentration around the grain boundaries. Therefore, the C content is preferably 0.10 mass % or less, more preferably 0.05 mass % or less, and even more preferably 0.025 mass % or less.

Cr (chromium) forms a passivation film at a surface of the resulting stainless steel, thus improving the corrosion resistance. Cr contents less than 13.0 mass % do not enhance the corrosion resistance sufficiently. Cr contents more than 15.0 mass % result in a relatively strong tendency to form a δ-ferrite phase, thus deteriorating the mechanical properties and SCC resistance of the resulting stainless steel. Therefore, the Cr content is preferably from 13.0 to 15.0 mass %, more preferably from 13.5 to 14.5 mass %, and even more preferably from 13.75 to 14.25 mass %.

Addition of Ni (nickel) suppresses formation of a δ-ferrite phase and enhances a tensile strength of the resulting stainless steel by the precipitation hardening effect of Ni—Ti—Al compounds. Ni also has an effect of increasing the quench hardening properties and the toughness of the resulting stainless steel. These effects are insufficient at Ni contents of less than 7.0 mass %. At Ni contents of more than 10.0 mass %, an austenite phase remains and precipitates, thereby degrading the mechanical strength (such as tensile strength) of the resulting stainless steel. Accordingly, the Ni content is preferably from 7.0 to 10.0 mass %, more preferably from 7.5 to 9.5 mass %, and even more preferably from 8.0 to 9.0 mass %.

Addition of Mo (molybdenum) improves the SCC resistance of the resulting stainless steel. This effect is insufficient at Mo contents less than 2.0 mass %. Mo contents more than 3.0 mass % result in an increased tendency to form a δ-ferrite phase, thereby degrading the mechanical properties and SCC resistance. Accordingly, the Mo content is preferably from 2.0 to 3.0 mass %, more preferably from 2.2 to 2.8 mass %, and even more preferably from 2.3 to 2.7 mass %.

Ti (titanium) is an essential element for improving the tensile strength of the resulting stainless steel because Ti forms carbides and Ni—Ti—Al compounds and thereby enhances the precipitation hardening properties. The Ti carbides are preferentially formed as compared to the Cr carbides. As a result, formation of Cr carbides is suppressed, thereby increasing the SCC resistance. Ti also has an effect of increasing the grain boundary corrosion resistance. The various effects described above are insufficient at Ti contents less than 0.5 mass %. Ti contents more than 2.5 mass % degrade the toughness of the resulting stainless steel due to precipitation of undesirable damaging phases and other factors. Accordingly, the Ti content is preferably from 0.5 to 2.5 mass %, more preferably from 1.0 to 2.0 mass %, and even more preferably from 1.25 to 1.75 mass %.

Al (aluminum) forms Ni—Ti—Al compounds, thereby enhancing the precipitation hardening properties of the resulting stainless steel. This effect is insufficient at Al contents less than 0.5 mass %. Al contents more than 2.5 mass % result in a relatively strong tendency to excessively precipitate Ni—Ti—Al compounds and form a δ-ferrite phase, thus deteriorating the characteristics of the resulting stainless steel. Accordingly, the Al content is preferably from 0.5 to 2.5 mass %, more preferably from 1.0 to 2.0 mass %, and even more preferably from 1.25 to 1.75 mass %.

Si (silicon) works as a deoxidizer when the stainless steel is molten. Only a small addition of Si is effective in providing such deoxidizing function. Si contents more than 0.5 mass % result in a relatively strong tendency to form a δ-ferrite phase, thus deteriorating the characteristics of the resulting stainless steel. Accordingly, the Si content is preferably 0.5 mass % or less, more preferably 0.25 mass % or less, and even more preferably 0.1 mass % or less. When the stainless steel is molten by vacuum carbon deoxidation (VCD) or electro slag remelting (ESR), no intentional Si addition is required.

Mn (manganese) works as a deoxidizer and a desulfurizing agent when the stainless steel is molten. Only a small addition of Mn is effective in providing such deoxidizing and desulfurizing functions. Mn also has an effect of suppressing δ-ferrite phase formation. Mn contents of 0.1 mass % or more are desirable in order to provide this suppression effect. However, Mn contents of more than 1.0 mass % degrade the toughness of the resulting stainless steel. Accordingly, the Mn content is preferably from 0.1 to 1.0 mass %, more preferably from 0.3 to 0.8 mass %, and even more preferably from 0.4 to 0.7 mass %.

Nb (niobium) forms carbides and precipitates, thereby increasing the mechanical strength of the resulting stainless steel. This effect is insufficient at Nb contents less than 0.05 mass %. Nb contents more than 0.5 mass % result in a relatively strong tendency to form a δ-ferrite phase of the steel. Accordingly, the Nb content is preferably from 0.05 to 0.5 mass %, more preferably from 0.1 to 0.45 mass %, and even more preferably from 0.2 to 0.3 mass %.

Part or all of the Nb may be replaced by V (vanadium) and/or Ta (tantalum). In this case, the preferred total content of Nb, V and Ta is the same as the above described preferred Nb content. That is, it is preferable to add at least one of Nb, V and Ta in a total content of from 0.05 to 0.5 mass %. The addition of V and/or Ta is not essential. However, V and Ta each give a stronger precipitation hardening effect.

Similarly to Mo, W (tungsten) has an effect of increasing the SCC resistance of the resulting stainless steel. The addition of W is not essential. However, the combined addition of Mo and W increases the SCC resistance more effectively than the addition of Mo alone. In this case, the preferred total content of Mo and W is the same as the above-described preferred addition of Mo alone (from 2.0 to 3.0 mass %) in order to prevent δ-ferrite phase precipitation.

The addition of Co (cobalt) has effects of suppressing δ-ferrite phase formation and enhancing the uniformity of the resulting martensite structure. These effects are insufficient at Co contents less than 0.5 mass %. At Co contents of more than 1.0 mass %, the austenite phase remains and precipitates, thereby degrading the mechanical strength (such as tensile strength) of the resulting stainless steel. Accordingly, the Co content is preferably from 0.5 to 1.0 mass %, more preferably from 0.6 to 0.9 mass %, and even more preferably from 0.7 to 0.8 mass %.

Re (rhenium) has an effect of improving the solution hardening properties of the resulting stainless steel. Re also has effects of increasing the toughness and SCC resistance. All these effects are insufficient at Re contents less than 0.5 mass %. Re is expensive; therefore the Re content is preferably less than about 1.0 mass % in order to reduce cost. Accordingly, the Re content is preferably from 0.5 to 1.0 mass %, more preferably from 0.6 to 0.9 mass %, and even more preferably from 0.7 to 0.8 mass %.

The term "incidental impurity", as used herein and the appended claims, refers to an unintentionally contained impurity such as one originally contained in a starting material and one contaminated during manufacture. Examples of incidental impurities are P (phosphorus), S (sulfur), Sb (antimony), Sn (tin) and As (arsenic). The martensitic stainless steel of the present invention unavoidably contains one or more such incidental impurities.

Reduction of P and S improves the toughness of the resulting stainless steel without sacrificing the mechanical strength; thus, the contents of P and S are each desirably suppressed to as low as possible. In the invented stainless steel, the contents of P and S are preferably independently 0.1 mass % or less (more preferably 0.05 mass % or less) in order to increase the toughness. Reduction of Sb, Sn and As also improves the toughness. Therefore, the contents of Sb, Sn and As are each also desirably suppressed to as low as possible. In the invented stainless steel, the contents of Sb, Sn and As are preferably independently 0.1 mass % or less, and more preferably 0.05 mass % or less.

In order to obtain a precipitation-hardening martensitic stainless steel having well-balanced properties of high mechanical strength, high toughness and high corrosion resistance, the inventors have intensively investigated the effect of the composition of various precipitation-hardening martensitic stainless steels on the mechanical strength, toughness and corrosion resistance. In particular, the control of the precipitation of carbides and/or Ni—Ti—Al compounds (which both strongly affect the mechanical strength) and the control of the precipitation of Cr compounds and/or Mo compounds (which both strongly affect the corrosion resistance) have been investigated.

By this investigation, the following was found: In order to increase the mechanical properties of precipitation-hardening martensitic stainless steels, it is effective to actively precipitate carbides and Ni—Ti—Al compounds. However, in order to maintain or increase the corrosion resistance, it is necessary to suppress the formation of undesirable damaging phases and the excessive formation of Cr carbides and/or Mo carbides. In order to mediate these contradictory requirements and obtain a precipitation-hardening martensitic stainless steel having well-balanced properties of high mechanical strength, high toughness and high corrosion resistance, it is found that the compositional balance among Ti, Al and C is the most important parameter. The present invention was developed based on this finding.

Figure 2:
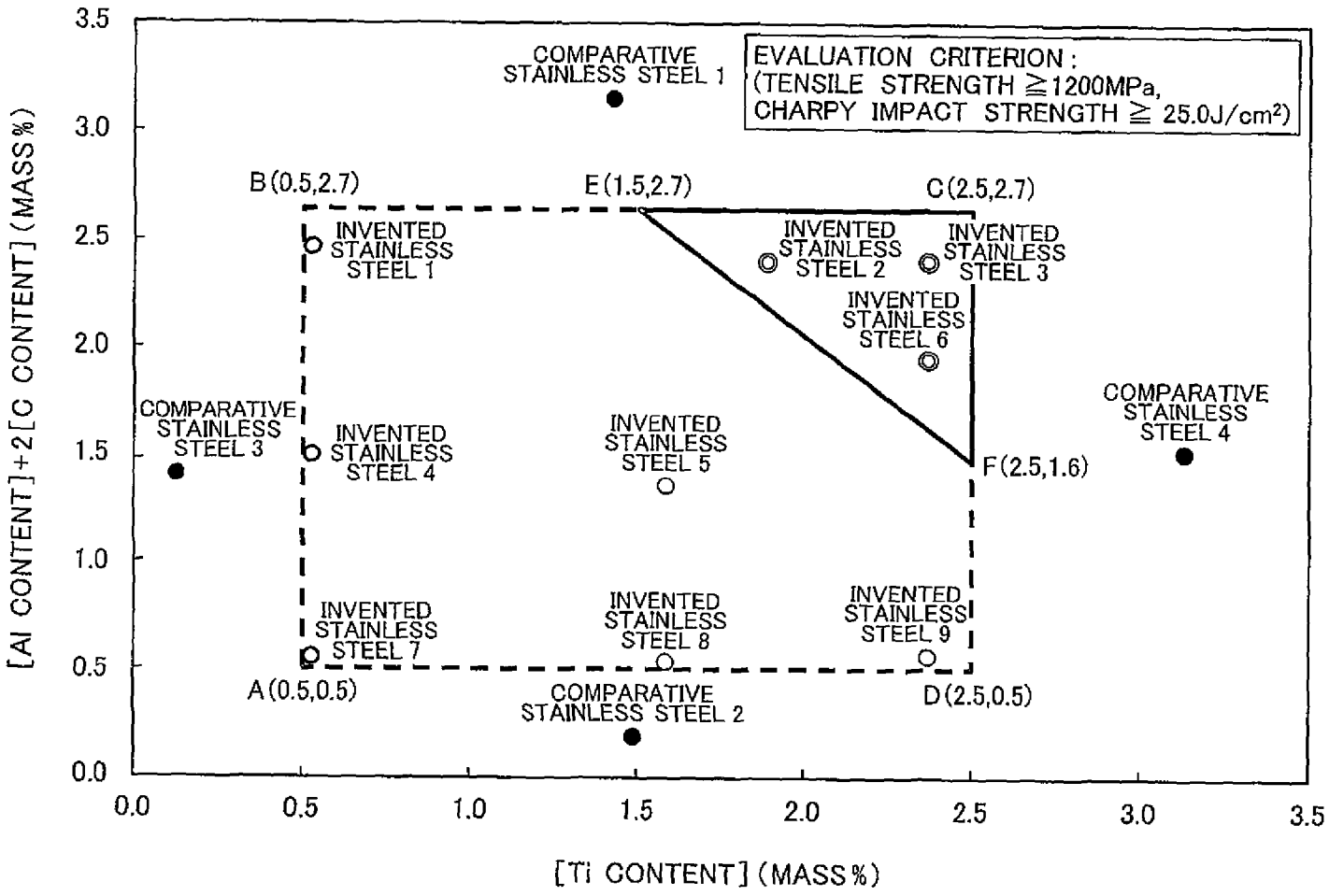
FIG. 2 is a graph showing a compositional balance among Ti, Al and C for Invented Stainless Steels 1 to 9 and Comparative Stainless Steels 1 to 4, in which the x-axis represents the Ti content and the y-axis represents the sum of the Al content and twice the C content.

The preferred compositional balance among Ti, Al and C according to the invention is described below with reference to FIG. 2. In FIG. 2, the x-axis represents the Ti content and the y-axis represents the sum of the Al content and twice the C content (i.e., [Al content]+2[C content]). Here, as described, Al and C each form a compound with Ti. The preferred compositional balance among Ti, Al and C lies within the rectangle ABCD formed by connecting the points A(0.5, 0.5), B(0.5, 2.7), C(2.5, 2.7) and D(2.5, 0.5). The more preferred compositional balance lies within the triangle CEF formed by connecting the points C(2.5, 2.7), E(1.5, 2.7) and F(2.5, 1.6). This more preferred compositional balance gives even better mechanical properties (i.e., a tensile strength much higher than 1500 MPa) and even better toughness properties (i.e., a Charpy impact strength much higher than 25.0 J/cm$^2$). More detailed description will be later.

(Method for Manufacturing Invented Stainless Steel)

Except for the preferred heat treatment of the present invention, there is no particular limitation on the method for manufacture of the invented precipitation-hardening martensitic stainless steel and any conventional method of manufacture may be used. The heat treatment according to the invention will be described below.

The preferred heat treatment of the invention is as follows: First, a pre-heat treated steel is solution treated by heating the stainless steel to 900° C. to 950° C. (more preferably 910° C. to 940° C.), maintaining it at that temperature, and then quenching it. By this solution heat treatment, elements to be precipitated are dissolved in the steel matrix, which is then transformed to the martensite structure. Then, the solution-treated steel is aging treated by heating it to 520° C. to 580° C. (more preferably 530° C. to 570° C., and even more preferably 530° C. to 550° C.), maintaining it at that temperature, and then cooling it slowly. By this aging heat treatment, carbides and Ni—Ti—Al compounds are formed and precipitated. By these solution and aging heat treatments, a precipitation-hardening martensitic stainless steel having such an advantageous structure that fine precipitates are dispersed in a uniform martensite matrix is obtained.

(Steam Turbine Component)

Because a precipitation-hardening martensitic stainless steel of the present invention has both good mechanical properties and good corrosion resistance, it is advantageously used for steam turbine components in thermal power plants. FIG. 1 is a schematic illustration showing a perspective view of an exemplary steam turbine long blade made of the invented stainless steel. The invented stainless steel is advantageously used for a long blade with a length of 48 to 60 inches (more advantageously 52 to 58 inches) for 3600 rpm steam turbines. As illustrated in FIG. 1, the steam turbine long blade 10 is of an axial entry type. The long blade 10 includes a blade profile section 1 (on which high-speed steam impinges) and a blade root section 2. In order to connect neighboring long blades 10, a stub 4 is formed at a central position of the profile section 1 and a shroud 5 is formed along the top edge of the profile section 1. An erosion shield 3 is formed on a side edge portion of the profile section 1 in order to protect the profile section 1 from erosion caused by impingement of high-speed steam containing liquid water particles. The erosion shield 3 may not be used when the erosion is not severe. Because the invented stainless steel has high corrosion resistance, the erosion shield 3 may not be used in a low corrosion environment.

An example of the erosion shield 3 is a Stellite (registered trademark, Co based alloy) plate. The Stellite plate can be welded to the long blade 10 by TIG welding, electron beam welding, brazing or the like. Preferably, after the welding of the Stellite plate, a stress removal (SR) heat treatment is performed at 550° C. to 650° C. (more preferably 570° C. to 630° C.) to remove residual stresses potentially causing cracks. Another method for protecting the profile section 1 from erosion is a surface hardening method, which involves hardening a surface region of a top portion of the profile section 1 by local heating using a high-energy laser or the like.

The steam turbine long blade may be machined from the invented stainless steel after the aging heat treatment. However, it is better to perform the machining from the invented stainless steel after the solution heat treatment but before the aging heat treatment (i.e., a stainless steel in which no carbides or Ni—Ti—Al compounds precipitate) because such a stainless steel is easier to machine or cut (i.e., the machinability is higher). In this case, the aging heat treatment is performed after the machining.

EXAMPLES

The present invention will be described in more detail below by way of examples. However, the invention is not limited to the specific examples below.

(Preparation of Invented Stainless Steels 1 to 12 and Comparative Stainless Steels 1 to 13)

First, various steel ingots having the compositions shown in Table 1 were prepared by melting starting materials in a vacuum induction melting furnace in a vacuum of $5.0\times10^{-3}$ Pa or lower and at a temperature of 1600° C. or higher. Each steel ingot was hot-forged into a rectangle bar (90 mm in width, 30 mm in thickness, and 1400 mm in length) by using a 1000-ton forging machine and a 250-kgf hammer forging machine. Next, the rectangle bar was further cut into a pre-heat treated stainless steel sample rod (45 mm in width, 30 mm in thickness, and 80 mm in length).

Each of the pre-heat treated stainless steel sample rod was subjected to the following heat treatment using a box furnace: Each pre-heat treated stainless steel sample rod of Invented Stainless Steels 1 to 12 and Comparative Stainless Steels 1 to 10 was solution heat treated by maintaining it at 930° C. for one hour and quenching it in room temperature water. Then, the solution treated sample rod was aging heat treated by maintaining it at 550° C. for two hours and cooling it in room temperature air.

Comparative Stainless Steel 11 was solution heat treated by maintaining it at 925° C. for one hour and cooling it in air. Then, the solution treated steel was aging heat treated by maintaining it at 540° C. for two hours and cooling it in air.

Comparative Stainless Steel 12 was solution heat treated by maintaining it at 1000° C. for one hour and cooling it in air. Then, the solution treated steel was aging heat treated by maintaining it at 575° C. for two hours and cooling it in air.

Comparative Stainless Steel 13 was solution heat treated by maintaining it at 1120° C. for one hour and quenching it by dipping in room temperature oil. Then, the solution treated steel was aging heat treated by maintaining it at 680° C. for two hours and cooling it in air.

TABLE 1

Composition of Martensitic Stainless Steel.

(Unit: mass %)

| | C | Cr | Ni | Si | Mn | Al | Mo | W | Ti | Nb | V | Ta | Co | Re | P | S |
|---|---|---|---|---|---|---|---|---|---|---|---|---|---|---|---|---|
| Invented Stainless Steel 1 | 0.03 | 14.12 | 9.05 | 0.04 | 0.14 | 2.40 | 2.28 | — | 0.52 | — | — | — | — | — | 0.002 | 0.005 |
| Invented Stainless Steel 2 | 0.03 | 13.99 | 9.13 | 0.03 | 0.14 | 2.33 | 2.26 | — | 1.88 | — | — | — | — | — | 0.002 | 0.003 |
| Invented Stainless Steel 3 | 0.03 | 14.13 | 9.12 | 0.04 | 0.16 | 2.35 | 2.22 | — | 2.36 | — | — | — | — | — | 0.003 | 0.004 |
| Invented Stainless Steel 4 | 0.03 | 14.06 | 9.08 | 0.05 | 0.13 | 1.45 | 2.19 | — | 0.52 | — | — | — | — | — | 0.002 | 0.002 |
| Invented Stainless Steel 5 | 0.02 | 14.14 | 9.09 | 0.05 | 0.12 | 1.32 | 2.13 | — | 1.58 | — | — | — | — | — | 0.003 | 0.002 |
| Invented Stainless Steel 6 | 0.03 | 14.21 | 9.11 | 0.05 | 0.12 | 1.88 | 2.14 | — | 2.36 | — | — | — | — | — | 0.003 | 0.002 |
| Invented Stainless Steel 7 | 0.03 | 14.12 | 9.01 | 0.05 | 0.12 | 0.58 | 2.09 | — | 0.52 | — | — | — | — | — | 0.003 | 0.002 |
| Invented Stainless Steel 8 | 0.03 | 14.11 | 9.13 | 0.05 | 0.12 | 0.56 | 2.11 | — | 1.58 | — | — | — | — | — | 0.003 | 0.002 |
| Invented Stainless Steel 9 | 0.03 | 14.02 | 9.07 | 0.05 | 0.12 | 0.59 | 2.31 | — | 2.36 | — | — | — | — | — | 0.003 | 0.002 |
| Invented Stainless Steel 10 | 0.03 | 14.02 | 9.07 | 0.05 | 0.12 | 1.02 | 1.17 | 1.11 | 0.52 | — | — | — | — | — | 0.003 | 0.002 |
| Invented Stainless Steel 11 | 0.04 | 14.06 | 9.14 | 0.05 | 0.13 | 0.91 | 2.12 | — | 0.53 | 0.21 | 0.12 | 0.11 | — | — | 0.003 | 0.002 |
| Invented Stainless Steel 12 | 0.03 | 14.11 | 9.11 | 0.02 | 0.17 | 0.96 | 2.22 | — | 0.56 | — | — | — | 0.71 | 0.72 | 0.003 | 0.002 |
| Comparative Stainless Steel 1 | 0.03 | 13.97 | 9.16 | 0.03 | 0.19 | 3.09 | 2.26 | — | 1.43 | — | — | — | — | — | 0.002 | 0.003 |
| Comparative Stainless Steel 2 | 0.03 | 14.07 | 9.25 | 0.05 | 0.14 | 0.21 | 2.22 | — | 1.49 | — | — | — | — | — | 0.002 | 0.003 |
| Comparative Stainless Steel 3 | 0.03 | 14.14 | 9.15 | 0.08 | 0.13 | 1.36 | 2.11 | — | 0.13 | — | — | — | — | — | 0.005 | 0.003 |
| Comparative Stainless Steel 4 | 0.03 | 14.07 | 9.25 | 0.05 | 0.14 | 1.47 | 2.22 | — | 3.12 | — | — | — | — | — | 0.002 | 0.003 |
| Comparative Stainless Steel 5 | 0.04 | 16.08 | 9.14 | 0.04 | 0.18 | 1.36 | 2.17 | — | 1.49 | — | — | — | — | — | 0.003 | 0.003 |
| Comparative Stainless Steel 6 | 0.03 | 10.52 | 9.21 | 0.04 | 0.15 | 1.45 | 2.23 | — | 1.31 | — | — | — | — | — | 0.003 | 0.002 |

TABLE 1-continued

Composition of Martensitic Stainless Steel.

(Unit: mass %)

| | C | Cr | Ni | Si | Mn | Al | Mo | W | Ti | Nb | V | Ta | Co | Re | P | S |
|---|---|---|---|---|---|---|---|---|---|---|---|---|---|---|---|---|
| Comparative Stainless Steel 7 | 0.03 | 14.58 | 12.86 | 0.04 | 0.15 | 1.37 | 2.13 | — | 1.28 | — | — | — | — | — | 0.003 | 0.002 |
| Comparative Stainless Steel 8 | 0.02 | 14.02 | 5.58 | 0.04 | 0.16 | 1.19 | 2.27 | — | 1.50 | — | — | — | — | — | 0.003 | 0.002 |
| Comparative Stainless Steel 9 | 0.03 | 14.11 | 9.21 | 0.06 | 0.15 | 1.35 | 3.56 | — | 1.36 | — | — | — | — | — | 0.003 | 0.003 |
| Comparative Stainless Steel 10 | 0.03 | 14.02 | 9.11 | 0.04 | 0.14 | 1.40 | 1.54 | — | 1.42 | — | — | — | — | — | 0.003 | 0.002 |
| Comparative Stainless Steel 11 | 0.03 | 12.34 | 8.47 | 0.07 | 0.04 | 1.22 | 2.15 | — | — | 0.01 | — | — | — | — | — | — |
| Comparative Stainless Steel 12 | 0.03 | 15.39 | 4.37 | 0.38 | 0.49 | — | 1.05 | — | — | 0.19 | — | — | — | — | — | — |
| Comparative Stainless Steel 13 | 0.11 | 10.08 | 0.61 | 0.05 | 0.50 | 0.02 | 0.12 | 2.44 | — | 0.12 | 0.21 | — | — | 0.12 | — | — |

Note 1:
The mark "—" means that the element was not intentionally added or the element was below detection limit.
Note 2:
In each sample, the balance includes Fe and incidental impurities (except P and S).

(Measurements and Evaluation Criteria)

Each of the heat treated stainless steel samples (Invented Stainless Steels 1 to 9 and Comparative Stainless Steels 1 to 13) was observed or measured for the microstructure, the room temperature tensile strength and the 0.02% proof stress (as representatives of the mechanical strength), the room temperature Charpy impact strength (as a representative of the toughness) and the SCC resistance (as a representative of the corrosion resistance). The methods of these observations and measurements and the evaluation criteria of the results are described below.

The microstructure observation was carried out by optical microscopy. Stainless steel samples having a uniform martensite structure in which the δ-ferrite phase content and the residual austenite phase content were independently 1.0% or less were evaluated as good and marked with "Passed" in Table 2. The other stainless steel samples were evaluated as bad and marked with "Failed". The contents of the δ-ferrite phase and the residual austenite phase were measured according to the inclusion rating defined in JIS G 0555.

For the tensile test, each heat-treated stainless steel sample rod was further machined to form a round rod test piece having a gauge portion of 30 mm in length and 6 mm in diameter. Using this test piece, the tensile strength and the 0.02% proof stress were measured by the tensile test defined in JIS Z 2241 at room temperature. Stainless steel samples having a tensile strength of 1200 MPa or more and a 0.02% proof stress of 800 MPa or more were evaluated as good and marked with "Passed" in Table 2. The other samples were marked with "Failed".

For the Charpy impact test, each heat-treated stainless steel sample rod was further machined to have a 2 mm V-notch. Using this test piece having a V-notch, the Charpy impact strength was measured by the Charpy impact test defined in JIS Z 2242 at room temperature. Stainless steel samples having a Charpy impact strength of 25.0 J/cm$^2$ or more were evaluated as good and marked with "Passed" in Table 2. The other samples were marked with "Failed".

For the SCC resistance measurement, a rectangular rod test piece (20 mm in gauge length, 4 mm in width, and 2 mm in thickness) was machined from each heat-treated stainless steel sample rod. Then, this test piece was subjected to a constant load tensile test (500 MPa) in a 3.5% aqueous NaCl solution (80° C.). Stainless steel samples that did not rupture until after 200 hours were evaluated as good and marked with "Passed" in Table 2. The other samples were marked with "Failed".

The results of these observations and measurements are summarized in Table 2.

TABLE 2

Evaluation Results.

| | Micro-structure | 0.02% Proof Stress | Tensile Stress | Charpy Impact Strength | SCC Resistance |
|---|---|---|---|---|---|
| Invented Stainless Steel 1 | Passed | Passed | Passed | Passed | Passed |
| Invented Stainless Steel 2 | Passed | Passed | Passed | Passed | Passed |
| Invented Stainless Steel 3 | Passed | Passed | Passed | Passed | Passed |
| Invented Stainless Steel 4 | Passed | Passed | Passed | Passed | Passed |
| Invented Stainless Steel 5 | Passed | Passed | Passed | Passed | Passed |
| Invented Stainless Steel 6 | Passed | Passed | Passed | Passed | Passed |
| Invented Stainless Steel 7 | Passed | Passed | Passed | Passed | Passed |
| Invented Stainless Steel 8 | Passed | Passed | Passed | Passed | Passed |
| Invented Stainless Steel 9 | Passed | Passed | Passed | Passed | Passed |
| Invented Stainless Steel 10 | Passed | Passed | Passed | Passed | Passed |
| Invented Stainless Steel 11 | Passed | Passed | Passed | Passed | Passed |
| Invented Stainless Steel 12 | Passed | Passed | Passed | Passed | Passed |
| Comparative Stainless Steel 1 | Failed | Passed | Passed | Failed | Failed |
| Comparative Stainless Steel 2 | Passed | Passed | Failed | Passed | Passed |
| Comparative Stainless Steel 3 | Passed | Passed | Failed | Passed | Failed |

TABLE 2-continued

Evaluation Results.

| | Micro-structure | 0.02% Proof Stress | Tensile Stress | Charpy Impact Strength | SCC Resistance |
|---|---|---|---|---|---|
| Comparative Stainless Steel 4 | Failed | Passed | Passed | Failed | Failed |
| Comparative Stainless Steel 5 | Failed | Passed | Passed | Failed | Failed |
| Comparative Stainless Steel 6 | Passed | Passed | Passed | Passed | Failed |
| Comparative Stainless Steel 7 | Failed | Failed | Passed | Passed | Failed |
| Comparative Stainless Steel 8 | Passed | Passed | Failed | Passed | Failed |
| Comparative Stainless Steel 9 | Failed | Passed | Passed | Failed | Passed |
| Comparative Stainless Steel 10 | Passed | Passed | Failed | Passed | Failed |
| Comparative Stainless Steel 11 | Passed | Passed | Passed | Passed | Failed |
| Comparative Stainless Steel 12 | Passed | Passed | Passed | Failed | Failed |
| Comparative Stainless Steel 13 | Passed | Passed | Passed | Failed | Failed |

As shown in Table 2, Invented Stainless Steels 1 to 9 had a uniform martensite structure containing no δ-ferrite phase and residual austenite phase. They all passed the evaluations of a tensile strength, a 0.02% proof stress and a Charpy impact strength, and thus exhibited good mechanical properties. They also had a good SCC resistance. It is thus demonstrated from the above results that the precipitation-hardening martensitic stainless steel according to the present invention has well-balanced properties of high mechanical properties, high toughness and high corrosion resistance.

By contrast, Comparative Stainless Steel 1 had a δ-ferrite phase precipitation content of 1.0% or more. It had a Charpy impact strength lower than the evaluation criterion and an SCC resistance lower than the evaluation criterion, and thus failed the evaluations. Comparative Stainless Steel 2 failed the evaluation of a tensile strength. Comparative Stainless Steel 3 failed the evaluations of a tensile strength and an SCC resistance. Comparative Stainless Steel 4 had a δ-ferrite phase precipitation content of 1.0% or more. It had a Charpy impact strength lower than the evaluation criterion and an SCC resistance lower than the evaluation criterion, and thus failed the evaluations.

Comparative Stainless Steel 5 had a 6-ferrite phase precipitation content of 1.0% or more. It failed the evaluation of a Charpy impact strength and an SCC resistance. Comparative Stainless Steel 6 failed the evaluation of an SCC resistance. Comparative Stainless Steel 7 had a residual austenite phase precipitation content of 1.0% or more and it had a 0.02% proof stress extremely lower than the evaluation criterion. It also failed the evaluation of an SCC resistance. Comparative Stainless Steel 8 failed the evaluations of a tensile strength and an SCC resistance. Comparative Stainless Steel 9 had a δ-ferrite phase precipitation content of 1.0% or more and it failed the evaluation of a Charpy impact strength. Comparative Stainless Steel 10 failed the evaluations of a tensile strength and an SCC resistance.

Comparative Stainless Steel 11 failed the evaluation of an SCC resistance. Comparative Stainless Steel 12 failed the evaluations of a Charpy impact strength and an SCC resistance. Comparative Stainless Steel 13 failed the evaluations of a Charpy impact strength and an SCC resistance.

FIG. 2 is a graph showing a compositional balance among Ti, Al and C for Invented Stainless Steels 1 to 9 and Comparative Stainless Steels 1 to 4. In FIG. 2, the x-axis represents the Ti content and the y-axis represents the sum of the Al content and twice the C content (i.e., [Al content]+2[C content]).

As shown in FIG. 2, Invented Stainless Steels 1 to 9 all lay within the rectangle ABCD formed by connecting the points A(0.5, 0.5), B(0.5, 2.7), C(2.5, 2.7) and D(2.5, 0.5). It is added that Invented Stainless Steel 3 had the highest tensile strength of the Invented Stainless Steels 1 to 9. In contrast to Invented Stainless Steels, Comparative Stainless Steels 1 to 4 (not according to the present invention) all lay outside the rectangle ABCD.

(Effect of Heat Treatment)

The invented stainless steel was subjected to various solution and aging heat treatments (Invented Stainless Steels 1, 3, 5, 7 and 9), and the effects were compared. Solution heat treatments at temperatures higher than 950° C. left too much residual austenite phase and resulted in poor mechanical strength (such as low tensile strength and low 0.02% proof stress). Solution heat treatments at temperatures lower than 900° C. increased undissolved precipitates, thus resulting in a nonuniform microstructure. Also, the mechanical strength of the resulting stainless steel was poor. It is thus demonstrated that the solution heat treatment is preferably performed at a temperature from 900° C. to 950° C.

Figure 3:
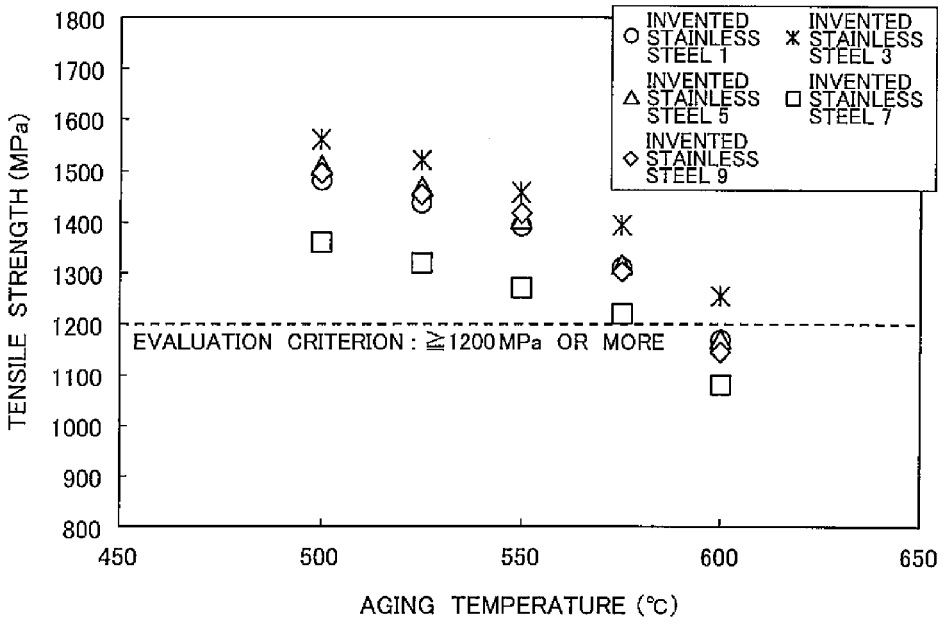
FIG. 3 is a graph showing a relationship between tensile strength and aging temperature.
Figure 4:
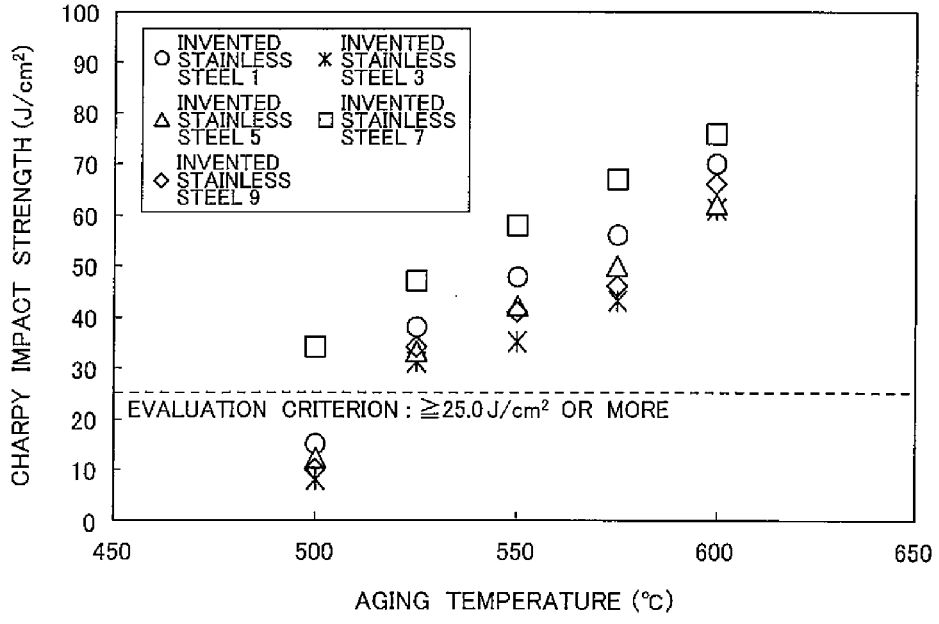
FIG. 4 is a graph showing a relationship between Charpy impact strength and aging temperature.

FIG. 3 is a graph showing a relationship between tensile strength and aging temperature. FIG. 4 is a graph showing a relationship between Charpy impact strength and aging temperature. As shown in FIGS. 3 and 4, aging temperatures higher than 580° C. result in a tensile strength lower than the above-described evaluation criterion, and aging temperatures lower than 520° C. result in a Charpy impact strength lower than the criterion. It is thus demonstrated that the aging temperature is preferably from 520° C. to 580° C. Aging temperatures from 530° C. to 570° C. are more preferable, and 530° C. to 550° C. are even more preferable.

(Steam Turbine Long Blade)

A steam turbine long blade was formed of Invented Stainless Steel 3 as follows: First, Invented Stainless Steel 3 was subjected to a vacuum carbon deoxidation, which involved melting and deoxidizing the stainless steel in a high vacuum of $5.0\times10^{-3}$ Pa by utilizing the chemical reaction of "C+O→CO". Next, the deoxidized stainless steel was formed into an electrode rod by extend forging. Then, the electrode rod was subjected to electroslag remelting, which involved immersing the rod in a molten slag, melting it by passing current therethrough, and resolidifying it in a water-cooled mold. By this electroslag remelting, a high-quality stainless steel ingot was obtained.

The stainless steel ingot was hot-forged, and then closed-die forged to form a 48-inch long blade. The die-formed long blade was solution heat treated by maintaining it at 930° C. for two hours and quenching it by forced cooling using a blower. Then, the long blade was aging heat treated by maintaining it at 550° C. for four hours and cooling it in air. Finally, finish processing, such as straightening (stress relief) and surface polishing, was performed to complete the formation of the 48-inch long blade.

A test specimen was cut out from each of a top end portion, a center portion and a root portion of the thus formed steam turbine long blade in such a manner that the length direction of each test specimen was parallel to the length direction of the long blade. Then, each test specimen was subjected to the above-described observations and measurements.

All the test specimens had a uniform martensite microstructure with no δ-ferrite phase and residual austenite phase. And, all the test specimens passed all of the above-described evaluations of a tensile strength, a 0.02% proof stress, a Charpy impact strength and an SCC resistance.

The above example is a 48-inch long blade. However, the application of the present invention is not limited to such a 48-inch long blade, but the invention can also be applied to 48 to 60 inch long blades.

As has been described, a precipitation-hardening martensitic stainless steel of the present invention has well-balanced properties of highly uniform martensite structure, high mechanical strength, high toughness and high corrosion resistance. Thus, the invented stainless steel can be advantageously applied to steam turbine long blades. The invention can also be applied to steam turbine rotors having such blades, steam turbines including such a rotor and thermal power plants using such a steam turbine. In addition to steam turbines, the invention can also be applied to components (such as blades) for other turbines such as gas turbine compressors.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A precipitation-hardening martensitic stainless steel consisting of:

0.10 mass % or less of C;

13.75 to 15.0 mass % of Cr;

7.0 to 10.0 mass % of Ni;

at least one of Mo and W, wherein the sum of Mo and W is 2.0 to 3.0 mass %;

0.52 to 2.5 mass % of Ti;

0.5 to 2.5 mass % of Al;

0.5 mass % or less of Si;

0.1 to 1.0 mass % of Mn;

at least one of Nb and Ta, wherein the sum of Nb and Ta is 0.05 to 0.5 mass %;

0.5 to 1.0 mass % of Co;

0.5 to 1.0 mass % of Re; and the balance being Fe and incidental impurities;

wherein the precipitation-hardening martensitic stainless steel has a uniform martensite structure with no δ-ferrite phase and residual austenite phase; a tensile strength of 1200 MPa or more; a 0.02% proof stress of 800 MPa or more; and a Charpy impact strength of 25.0 $J/cm^2$ or more, and wherein the precipitation-hardening martensitic stainless steel has been subjected to a solution heat treatment at 900° C. to 950° C. followed by an aging heat treatment at 520° C. to 580° C.

2. The precipitation-hardening martensitic stainless steel according to claim 1, wherein the incidental impurities are at least one of: 0.1 mass % or less of P; 0.1 mass % or less of S; 0.1 mass % or less of Sb; 0.1 mass % or less of Sn; and 0.1 mass % or less of As.

3. A long blade with a length of 48 to 60 inches made of the precipitation-hardening martensitic stainless steel according to claim 1 for a 3600 rpm steam turbine.

4. A rotor comprising the long blade according to claim 3.

5. A steam turbine comprising the rotor according to claim 4.

6. A thermal power plant comprising a 3600-rpm steam turbine, wherein the 3600-rpm steam turbine comprises a rotor, wherein the rotor comprises a long blade, and wherein the long blade has a length of 48 to 60 inches and is made of the precipitation-hardening martensitic stainless steel according to claim 1.

7. A precipitation-hardening martensitic stainless steel consisting of:

0.10 mass % or less of C;

13.75 to 15.0 mass % of Cr;

7.0 to 10.0 mass % of Ni;

both Mo and W, wherein the sum of Mo and W is 2.0 to 3.0 mass %;

0.52 to 2.5 mass % of Ti;

0.5 to 2.5 mass % of Al;

0.5 mass % or less of Si;

0.1 to 1.0 mass % of Mn;

at least one of Nb and Ta, wherein the sum of Nb and Ta is 0.05 to 0.5 mass %; and the balance being Fe and incidental impurities;

wherein the precipitation-hardening martensitic stainless steel has a uniform martensite structure with no δ-ferrite phase and residual austenite phase; a tensile strength of 1200 MPa or more; a 0.02% proof stress of 800 MPa or more; and a Charpy impact strength of 25.0 $J/cm^2$ or more, and wherein the precipitation-hardening martensitic stainless steel has been subjected to a solution heat treatment at 900° C. to 950° C. followed by an aging heat treatment at 520° C. to 580° C.

* * * * *